US005360032A

United States Patent [19]

Schenk

[11] Patent Number: 5,360,032

[45] Date of Patent: Nov. 1, 1994

[54] CONTROL VALVE ASSEMBLY

[76] Inventor: Rudolf Schenk, Alte Distelbergstrasse 5, CH-5035 Unterentfelden, Switzerland

[21] Appl. No.: 113,974

[22] Filed: Aug. 30, 1993

[30] Foreign Application Priority Data

Aug. 31, 1992 [DE] Germany ..... 4228944

[51] Int. Cl.[5] ..... F16K 15/06; F16K 17/04

[52] U.S. Cl. ..... 137/454.5; 137/512.3; 137/596.2

[58] Field of Search ..... 137/506, 596.2, 493.9, 137/512.3, 512, 454.2, 454.5

[56] References Cited

U.S. PATENT DOCUMENTS

| | | | |
|---|---|---|---|
| 1,628,069 | 5/1927 | Schmidt | 137/512 |
| 1,861,396 | 5/1932 | Isbell | 137/512 |
| 4,185,656 | 1/1980 | Braukmann | 137/512.3 |

FOREIGN PATENT DOCUMENTS

| | | | |
|---|---|---|---|
| 904376 | 11/1945 | France | 137/512 |
| 915117 | 10/1946 | France | 137/512 |
| 847094 | 8/1952 | Germany | 137/512.3 |
| 567681 | 4/1956 | Italy | 137/512 |

*Primary Examiner*—Stephen M. Hepperle
*Attorney, Agent, or Firm*—Tarolli, Sundheim & Covell

[57] ABSTRACT

The invention provides a control valve assembly essentially comprising a housing, a check valve member, a safety valve member as well as a support body member. The housing is provided with an inlet chamber, an outlet chamber and a back flow chamber. Between the inlet chamber and the outlet chamber, there is provided a first orifice, and between the outlet chamber and the back flow chamber there is provided a second orifice. The check valve member and the safety valve member are mounted one behind the other one in axial alignment in a support body member and form a modular unit. This modular unit is inserted into the housing such that the first orifice is closed by the check valve member and the second orifice by the safety valve member. If one or both of these valve members need service, the aforementioned modular unit can easily be removed from the control valve assembly and repaired.

11 Claims, 3 Drawing Sheets

CONTROL VALVE ASSEMBLY

FIELD OF THE INVENTION

The present invention refers to a control valve assembly, particularly for home water supply installations, comprising a housing having mounted therein a check valve member and a safety valve member.

Such control valve assemblies are used primarily in household water supply installations. Usually, such a control valve assembly is inserted into a fresh water supply conduit which supplies fresh water to a boiler. The known control valve assemblies normally comprise a housing with a check valve and a safety valve inserted therein. These two valves are functionally series connected in such a manner that the safety valve is behind the check valve, as seen in the direction of the flow of the fresh water.

The function of the check valve is to prevent that water can flow back from the boiler into the fresh water supply conduit. The provision of the safety valve which is located functionally more close to the boiler, it is ensured that the water expanding when the boiler is heated does not exceed a certain pressure selectable at the safety valve thus, the safe operation of such an installation is ensured.

Known embodiment of such control valve assemblies are designed such that the portion of the housing in which the check valve is received is constituted by a water conduit portion which is inserted into the fresh water supply conduit of the boiler. This water conduit portion is provided with a radially extending outlet to which is connected a T-shaped branch conduit. The safety valve member is inserted from upwards into one leg of the T-shaped branch conduit, while the second, axially flushing leg of the T-shaped branch conduit serves as a downwardly directed outlet through which water can escape which has a too high pressure and which has been released by the check valve member.

Such a design of a control valve assembly has a number of disadvantages:

- The space requirement of such a control valve assembly is quite high.
- If the check valve does not function properly, the entire housing with the valve member received therein must be removed from the fresh water supply conduit. Such a repair operation takes a long time and, consequently, a long interrupt in the water supply.
- The individual components of the check valve member and the safety valve member are not replaceable with the result that, upon a defect of a component, the entire check valve or the entire safety valve has to be replaced. It is understood that this occurs unnecessarily high costs.

OBJECTS OF THE INVENTION

It is an object of the invention to provide a control valve assembly which can be repaired or replaced easier and with less expenditure of time.

It is a further object of the invention to provide a control valve assembly which is of compact design and, consequently, can easily be integrated into a water supply installation.

SUMMARY OF THE INVENTION

To meet these and other objects, the invention provides, according to a first aspect, a control valve assembly, particularly for home water supply installations, comprising a housing having mounted therein a check valve member and a safety valve member and a support body member adapted to receive the check valve member and the safety valve member. Thereby, the design is such that the check valve member and the safety valve member are arranged in the support body member one behind the other one along a common central longitudinal axis.

The support body member together with the check valve member and the safety valve member received therein form a modular unit which is releasably inserted into the housing.

According to a second aspect of the invention, there is provided a control valve assembly, particularly for home water supply installations, comprising a housing having an inlet chamber, an outlet chamber and a flow back chamber, a first orifice between located the inlet chamber and the outlet chamber, and a second orifice located between the outlet chamber and the flow back chamber.

The housing receives a check valve member and a safety valve member as well as a support body member adapted to receive the check valve member and the safety valve member. The check valve member and the safety valve member are arranged in the support body member one behind the other one along a common central longitudinal axis such that the first orifice can be closed by the check valve member and that the second orifice can be closed by the safety valve member. Thereby, the support body member together with the check valve member and the safety valve member received therein constitute a modular unit which is releasably inserted into the housing.

Due to the fact that the check valve member and the safety valve member are mounted one behind the other one in axial alignment in the support body member and thereby form a modular unit, the space requirements of the entire control valve assembly can be reduced. Such a design has the additional advantage that no branch conduit for the safety valve member must be provided.

In a preferred embodiment of the invention, the support body member has a first end portion and a second end portion whereby the check valve member is inserted into the aforementioned first end portion and the safety valve member is inserted into the aforementioned second end portion. The support body member is provided with a thread by means of which the valve unit consisting of the check valve member, the safety valve member and the support body member can be fixed in a corresponding thread in the housing. Such a design has the great advantage that both valve members can be replaced particularly quickly and easily.

A further embodiment of the control valve assembly is provided with an auxiliary body member. This auxiliary body member is inserted into a central bore running coaxially to the central longitudinal axis of the support body member. Each of the both front faces of the auxiliary body member is provided with a tube-shaped protrusion. One of these tube-shaped protrusions has a cylindrically shaped outer surface which serves as a guiding means for a valve body member of the check valve. The other one of these tube-shaped protrusions is provided with a front face serving as a sealing surface for a valve body member of the safety valve member.

Due to the modular design of the control valve assembly according to the invention, it is possible to remove it from a water supply installation and to disassemble it quickly and easily. The result is that servicing and maintenance is made much more easier and less expensive than in control valve assemblies according to the prior art.

BRIEF DESCRIPTION OF THE DRAWINGS

In the following, two embodiments of the control valve assembly according to the invention will be further described, with reference to the accompanying drawings, in which.

DETAILED DESCRIPTION OF THE PREFERRED EMBODIMENTS

Figure 1:
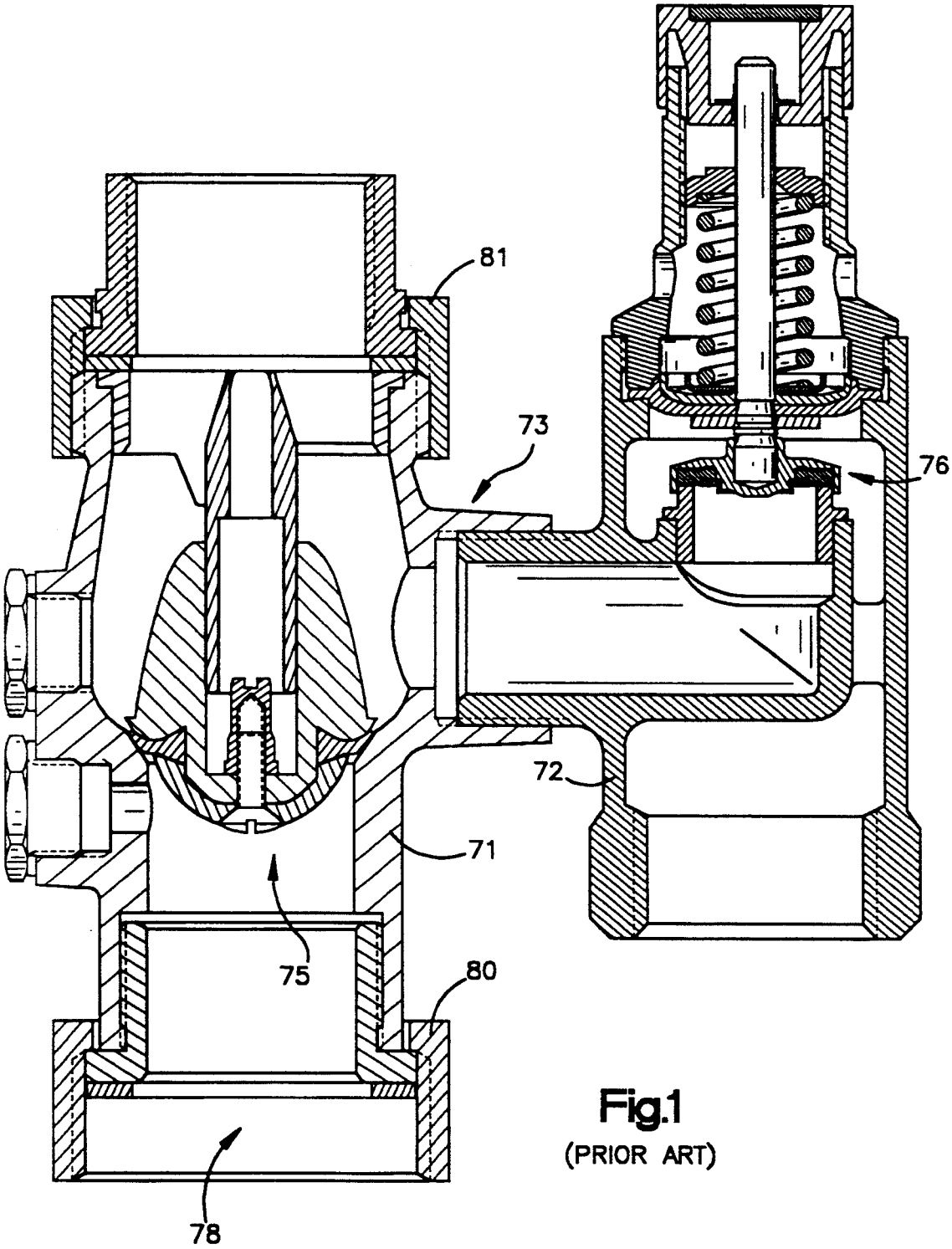
Fig.1 (PRIOR ART)
FIG. 1 shows an embodiment known in the prior art.

In FIG. 1, there is shown a control valve assembly known in the prior art. This control valve assembly comprises a housing consisting of two housing portions 71 and 72. In the main housing portion 71, a check valve 74 is ranged while the branch housing portion 72 receives a safety valve member 76. The branch housing portion 72 is provided with a radially extending housing protrusion 73 which is screwed into the main housing portion 71. The main housing portion 71 is connected to a fresh water conduit 78 by means of two union knobs 80 and 81.

As can be clearly seen from FIG. 1, the whole control valve assembly must be removed from the fresh water conduit 78 if the check valve 75 becomes defective or must be cleaned. It is under-stood that such an operation requires a great expenditure and can not be performed by a person not skilled in the art. Furthermore it can be recognized from FIG. 1 that particular parts of the control valve assembly can not be exchanged without quite a great effort.

Figure 2:
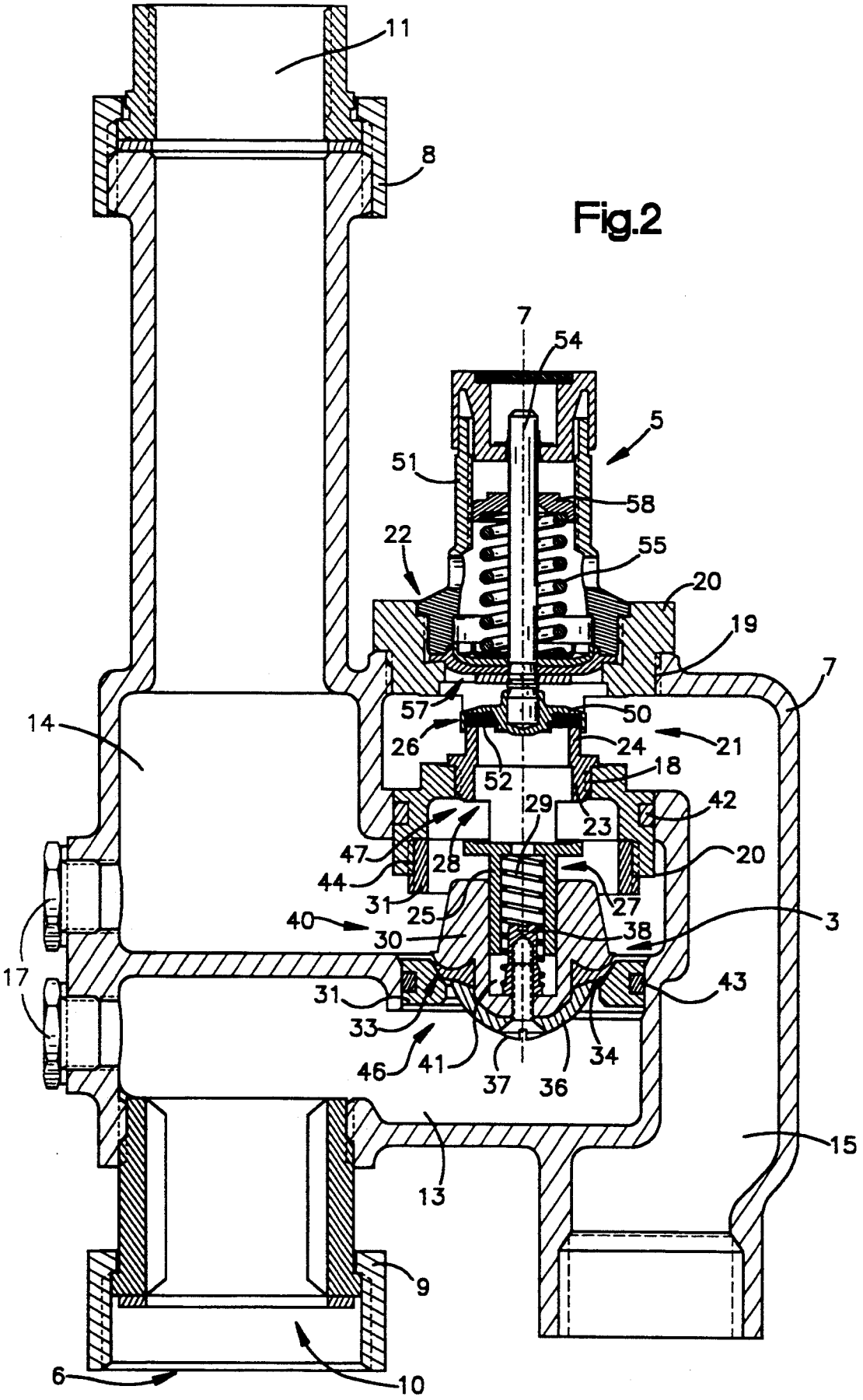
FIG. 2 shows a first embodiment of a control valve assembly according to the invention in which the valve assembly is arranged in vertical direction.

In FIG. 2 there is shown a first embodiment of the control valve assembly according to the invention. This control valve assembly essentially comprises a housing 1, a support body member 20, a check valve 3 as well as safety valve 5. The support body member 20 is provided with a central bore 22. As can be seen in FIG. 2, the check valve 3 is inserted into the support body member 20 from the lower side thereof while the safety valve 5 is inserted into the support body member 20 from the upper side thereof. Thus, the arrangement of the two valves 3 and 5 is axially flushing.

The check valve 3, the safety valve 5 and the support body member 20 together form a modular unit which is connected to the housing 1 by means of a thread 19 and a corresponding thread provided in the housing 1. As can be seen in FIG. 2, the aforementioned modular unit has a vertical orientation with regard to the housing 1. In order to seal the support body member 20 with regard to the housing 1, the end of the thread facing the safety valve member 5 is provided with an annular sealing member.

The housing 1 is connected to a fresh water conduit 6 by means of two union knobs 8 and 9. The fresh water conduit 6 is provided with an inlet 10 and outlet 11. Usually the outlet 11 is connected to a boiler which, however, is not shown in the drawings for the reasons of clarity.

The check valve 3 as well as the safety valve 5 are of conventional design; thus, the need is removed to further explain the exact function and operation thereof. In the following, only the most important characteristics of these valves and the differences with regard to known valves will be explained.

The check valve 3 essentially consists of a valve body member 30 and a sealing body member 31. The valve body member 30 is provided with a cylindrical blind bore 41 located at the back side of the valve body member 30. The front portion of the valve body member 30 is provided with a sealing lip 34 surrounding the valve body member 30 and being fixed to the lateral one by means of a cap 36. The cap 36 itself is fixed in its location by means of a screw 37 which is screwed into a nut 38 received in the blind bore 41. The sealing body member 31 is screwed by means of a thread 44 in a corresponding thread providing in the support body member 20. Furthermore, annular sealing members 42 and 43 are provided in order to seal the sealing body member 31 and the support body member 20 with regard to the housing 1. The annular sealing members 42 and 43 surround the sealing body member 31 and the support body member 20, respectably, at the lower ends thereof and are received in circular grooves. The sealing body member 31 is further provided with radially extending channels 40 and comprises a lower oblique sealing surface 33.

The safety member 5 essentially consists of a valve body member 50 which is connected to and guided by a valve rod member 54. The valve body member 50 is disc-shaped and is provided with an annular sealing member 52 located at its lower end. The valve body member 50 is biased by means of a spring 55 acting on the valve rod member 54. The spring 55 abuts against a spring plate 58. This spring plate 58 is provided with a thread by means of which it is connected to housing 51 surrounding the safety valve 5. Thereby, the spring plate 58 is adjustable as far as its vertical position is concerned thus, the biasing force of the spring 55 and, therewith, the one of the valve body member 50 may be adjusted. Furthermore, in order to seal the safety valve 5 with regard to the housing 1, there is provided a sealing washer 57 located at the lower end of the housing 51 of the safety valve.

An auxiliary body member 23 is screwed into the support body member 20 by means of a thread 18; said auxiliary body member 23 is located between the check valve 3 and the safety valve 5. The auxiliary body member 23 is provided with an annular sealing member located at the end of the thread 18 in order to seal the auxiliary body member 23 against the support body member 20. Furthermore, the auxiliary body member 23 is provided at its both front faces, as seen with reference to a central longitudinal axis 7, with tube-shaped projections 24 and 25. The lower projection 25 thereby is designed such that its cylindrical outer face correspond with the blind bore 41 of the valve body member 30 as far as shape and position are concerned. Thus, the auxiliary body member 23 is positively guided.

In the aforementioned projection 25, a spring 29 is supported by means of which the valve body member 30 is biased. The upper projection 24 of the auxiliary body member 23 is designed such that its front face 26 corresponds to the valve body member 50 of the safety valve 5 as far as shape and position are concerned. The result is that the annular sealing member 52 of the valve body member 50 plainly abuts there against in order to insure a reliable sealing.

In the interior of the housing 1, there are provided an inlet chamber 13, an outlet chamber 14 as well as a back flow chamber 15. Between the inlet chamber 13 and the outlet chamber 14, a first orifice 46 and between the outlet chamber 14 and the back flow chamber 15 a second orifice is provided. Functionally seen, the check valve 3, thereby, is located in the region of the orifice 46 and the safety valve 5 is located in the region of the orifice 47.

In order to insure that the operation of the two valves 3 and 5 can be checked, the housing 1 is provided with two connection pieces 17.

In the following, the mode of operation of the entire control valve assembly will be explained in detail. Thereby, it is assumed that the control valve assembly still is empty and that the (not shown) boiler is not yet filled with water.

The fresh water entering the control valve assembly through the inlet 10 first is led into the inlet chamber 13. From the inlet chamber 13, the water flows into the outlet chamber 14 and thereby passes the check valve 3 since the safety valve 5 is closed in its rest position. From the outlet chamber 14, the water finally can flow through the outlet 11 into a (not shown) boiler. As soon as the value of the pressure in the inlet chamber 13 is about equal to the value of the pressure in the outlet chamber 14 (i.e. when the boiler is completely filled with water), the valve body member 30 of the check valve 3 is moved downward under the influence of the biasing force of the related spring. Thereby, the valve body member 30 closes the fist orifice 46 because the sealing lip 34 abuts against the sealing surface 34 of the sealing body member 31. Now, if the water contained in the boiler is heated, the water will expend. The result is that the pressure in the water rises and, thus, the value of the pressure in the outlet chamber 14 is higher than the value of the pressure in the inlet chamber 13.

It is the task of the check valve 3 to avoid that the pressure difference between the two chambers 13 and 14 can be equalized; this is possible due to the fact that the valve body member 30 of the check valve 3 is biased on its backside with a higher pressure and therefore seals the first orifice 46 with an increased force which is essentially proportional to the aforementioned pressure difference. However, if the pressure in the outlet chamber 14 exceeds a certain value, the safety valve 5 is put into operation. The valve body member 50 of the safety valve 5 is exposed to the pressure present in the outlet chamber 14 through the radially extending channels 21 of the support body member 20 as well as of the auxiliary body member 23. As soon as the force adjusted in the valve body member 50 by means of the related biasing spring 55 is exceeded, the valve body member 50 is displaced upwardly. The result is that the water can flow out from the upper protrusion 24 of the auxiliary body member 23 into the back flow chamber 15 so that the pressure in the outlet chamber 14 is decreased.

Considering the fact that the check valve 3 as well as the safety valve 5 are subjected to a certain wear, it is important that the two valves 3 and 5 can be quickly and easily be replaced in the case of a damage or malfunction. In the control valve assembly according to the invention, this prerequisition is given since the entire unit is connected to the housing 1 by means of a thread 19 provided in the support body member 20. Thus, the entire valve unit comprising the check valve 3 an d the safety valve 5 can easily be replaced even by a person not skilled in the art. Furthermore, since all essential elements of the control valve assembly are fixed by means of screwed connections, the removed valve unit can be disassembled without problems, the destroyed or damaged members thereof can be replaced and the reassembled valve unit can be inserted back into the control valve assembly.

Figure 3:
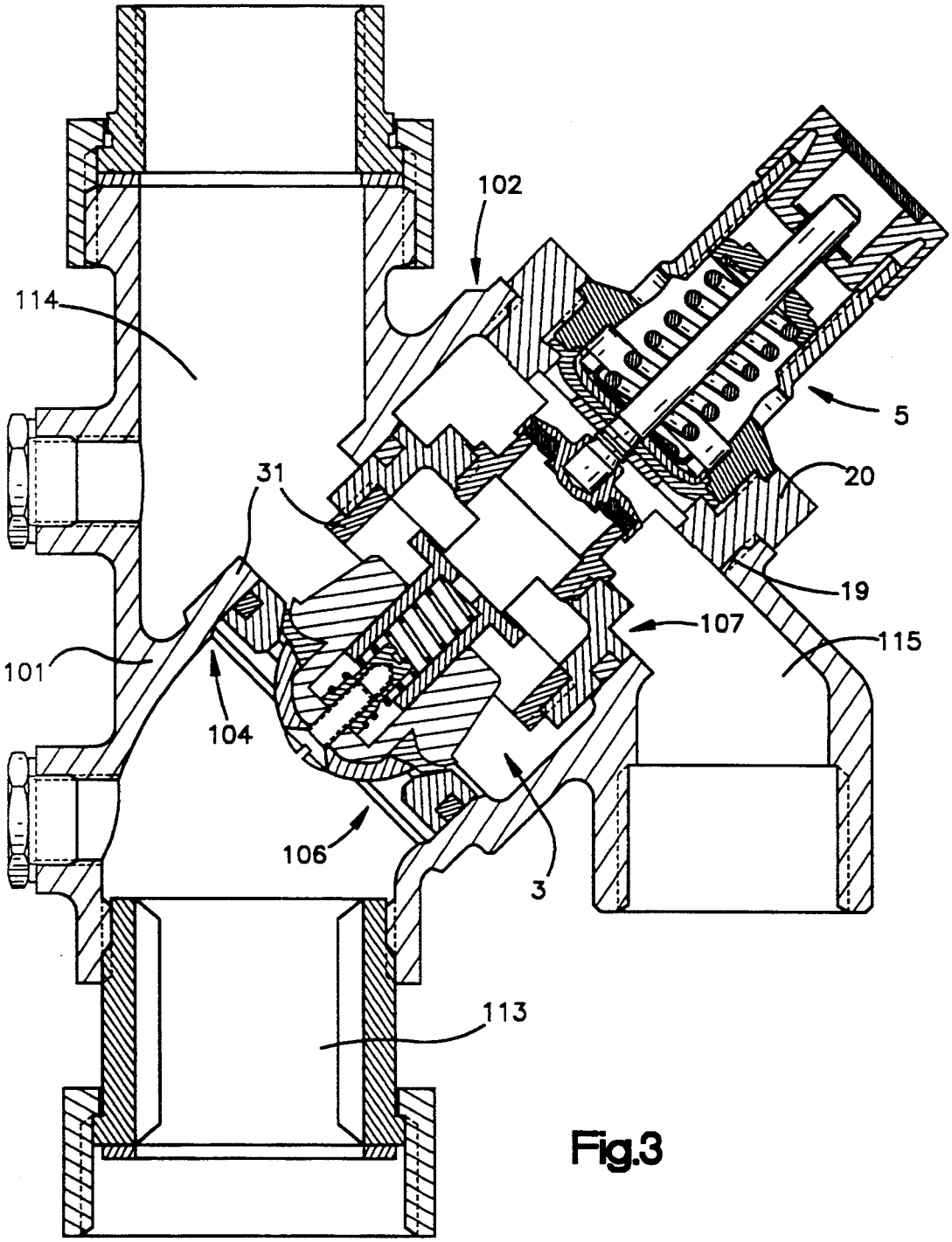
FIG. 3 shows a second embodiment of a control valve assembly according to the invention in which the valve assembly is arranged in oblique direction.

In FIG. 3, There is shown as second embodiment of the control valve assembly according to the invention. The entire valve unit itself is identical with the one shown in FIG. 2 and explained in connection therewith. The main difference of the second embodiment compared with the embodiment shown in FIG. 2 can be seen in the design of the housing 101 and in the mounting position of the control valve assembly.

Again, the housing 101 comprises an inlet chamber 113, an outlet chamber 114 and a flow back chamber 115. Between the inlet chamber 113 and the outlet chamber 114, there is provided a first orifice and, between the outlet chamber 114 and the flow back chamber 115 a second orifice 107. As can be seen in FIG. 3, the modular valve unit comprising the check valve 3, the safety valve 5 as well as the support body member 20 is mounted in the housing 101 under an angel of about 45°. For this purpose, the housing 101 is provided with a flange member 102 which is inclined by 45° with regard to the central longitudinal axis of the housing 101. The modular valve unit is connected to the aforementioned flange member 102 by means of a thread 19 provided at the support body member 20. The inlet chamber 113 is provided with a upwardly curved portion such that the upper inner face 104 thereof comes into contact with a sealing body member of the check valve B.

From this illustration, the compact design of such a control valve assembly according to the invention is particularly clearly evident.

What is claimed is

1. A home water supply station comprising:

a housing having an inlet chamber, an outlet chamber, and a flow back chamber.

a first orifice located between said inlet chamber and said outlet chamber, and a second orifice located between said outlet chamber and said flow back chamber;

a check valve member and a spring loaded safety valve member;

a support body member adapted to receive said check valve member and said safety valve member;

said check valve member and said safety valve member being arranged in said support body member one behind the other one along a common central longitudinal axis such that said first orifice can be closed by said check valve member and that said second orifice can be closed by said safety valve member;

said support body member together with said check valve member and said safety valve member received therein forming a modular unit; and said modular unit being releasably inserted into said housing in such a manner that it can be removed from the outer side of said housing.

2. A home water supply station according to claim 1 in which said support body member has a first end portion and a second end portion, said check valve member being inserted into said support body member at said first end portion and said safety valve member being inserted into said support body member from at said second end portion.

3. A home water supply station according to claim 1 in which said support body member has a central longitudinal axis and is provided with a central bore running coaxially to said central longitudinal axis as well as with channels extending radially to said central longitudinal axis, said channels serving for releasing water coming from said safety valve member.

4. A home water supply station according to claim 1 in which said check valve member comprises a sealing body member which is inserted in said support body member and which comprises, with respect to its longitudinal central axis, radially extending channels communicating with said outlet chamber of said housing.

5. A home water supply station according to claim 1 in which said support body member is provided with an outer thread by means of which it is connected to said housing of said control valve assembly.

6. A control valve assembly, particularly for home water supply installations, comprising:

a housing having mounted therein a check valve member and a safety valve member;

a support body member adapted to receive said check valve member and said safety valve member;

said check valve member and said safety valve member being arranged in said support body member one behind the other one along a common central longitudinal axis;

said support body member together with said check valve member and said safety valve member received therein forming a modular unit which is releasably inserted into said housing;

said support body member having a central longitudinal axis and being provided with a central bore running coaxially to said central longitudinal axis as well as with channels extending radially to said central longitudinal axis, said channels serving for releasing water coming from said safety valve member; and an auxiliary body member inserted into said central bore and having at each of its both front faces a tube-shaped protrusion, said auxiliary body member being further provided with radially extending channels located between said two tube-shaped protrusions which channels communicate with said radially extending channels of said auxiliary body member via one of said tube-shaped protrusions.

7. A control valve assembly, particularly for home water supply installations, comprising:

a housing having an inlet chamber, an outlet chamber, and a flow back chamber;

a first orifice located between said inlet chamber and said outlet chamber, and a second orifice located between said outlet chamber and said flow back chamber;

a check valve member and a safety valve member;

a support body member adapted to receive said check valve member and said safety valve member;

said check valve member and said safety valve member being arranged in said support body member one behind the other one along a common central longitudinal axis such that said first orifice can be closed by said check valve member and that said second orifice can be closed by said safety valve member;

said support body member together with said check valve member and said safety valve member received therein forming a modular unit which is releasably inserted into said housing;

said support body member having a central longitudinal axis and being provided with a central bore running coaxially to said central longitudinal axis as well as with channels extending radially to said central longitudinal axis, said channels serving for releasing water coming from said safety valve member; and an auxiliary body member inserted into said central bore and having at each of its both front faces a tube-shaped protrusion, said auxiliary body member being further provided with radially extending channels located between said two tube-shaped protrusions which channels communicate with said radially extending channels of said auxiliary body member via one of said tube-shaped protrusions.

8. A control valve assembly according to claim 6 in which one of said tube-shaped protrusions has a cylindrically shaped outer surface which serves as a guide means for a valve body member of said check valve, and in which the other one of said tube-shaped protrusions is provided with a front face which serves as a sealing surface for a valve body member of said safety valve member.

9. A control valve assembly according to claim 7 in which one of said tube-shaped protrusions has a cylindrically shaped outer surface which serves as a guide means for a valve body member of said check valve, and in which the other one of said tube-shaped protrusions is provided with a front face which serves as a sealing surface for a valve body member of said safety valve member.

10. A control valve assembly, particularly for home water supply installations, comprising:

a housing having an inlet chamber, an outlet chamber, and a flow back chamber;

a first orifice located between said inlet chamber and said outlet chamber, and a second orifice located between said outlet chamber and said flow back chamber;

a check valve member and a safety valve member;

a support body member adapted to receive said check valve member and said safety valve member;

said check valve member and said safety valve member being arranged in said support body member one behind the other one along a common central longitudinal axis such that said first orifice can be closed by said check valve member and that said second orifice can be closed by said safety valve member;

said support body member together with said check valve member and said safety valve member received therein forming a modular unit which is releasably inserted into said housing;

said check valve member comprising a sealing body member which is inserted in said support body member and which comprises, with respect to its longitudinal central axis, radially extending channels communicating with said outlet chamber of said housing; and said sealing body member being provided with a chamfered inner surface which serves as a sealing surface for said sealing body member, in which said support body member is provided with a first annular sealing member surrounding its outer side and being located at its lower side facing said check valve member, and in which said sealing body member is provided with a second annular sealing member surrounding its outer side and being located at its lower side remote from said support body member, whereby said first annular sealing member serves for sealing said sealing body member against said first orifice and said second annular sealing member serves for sealing said sealing body member against said second orifice.

11. A control valve assembly according to claim 6 or 7 in which said auxiliary body member is provided with a thread located between one of said protrusions and said radially extending channels, said thread serving for connecting said auxiliary body member by screwing it in into a corresponding thread provided in said support body member.

* * * * *